US010350888B2

(12) United States Patent
Mantell et al.

(10) Patent No.: US 10,350,888 B2
(45) Date of Patent: Jul. 16, 2019

(54) PRINTHEAD CONFIGURED FOR USE WITH HIGH VISCOSITY MATERIALS

(71) Applicant: Xerox Corporation, Norwalk, CT (US)

(72) Inventors: David A. Mantell, Rochester, NY (US); Peter J. Nystrom, Webster, NY (US); Peter Gulvin, Webster, NY (US); Andrew W. Hays, Fairport, NY (US); Jun Ma, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 415 days.

(21) Appl. No.: 14/563,563

(22) Filed: Dec. 8, 2014

(65) Prior Publication Data

US 2016/0159092 A1 Jun. 9, 2016

(51) Int. Cl.
*B41J 2/14* (2006.01)

(52) U.S. Cl.
CPC ..... *B41J 2/14* (2013.01); *B41J 2002/14354* (2013.01); *B41J 2002/14459* (2013.01); *B41J 2202/11* (2013.01)

(58) Field of Classification Search
None
See application file for complete search history.

(56) References Cited

U.S. PATENT DOCUMENTS

| | | | | |
|---|---|---|---|---|
| 5,463,416 | A | 10/1995 | Paton et al. | |
| 5,541,630 | A * | 7/1996 | Ema | B41J 2/14233 347/70 |
| 5,719,604 | A * | 2/1998 | Inui | B41J 2/14 347/54 |
| 6,352,337 | B1 * | 3/2002 | Sharma | B41J 2/14427 347/56 |
| 7,549,731 | B2 | 6/2009 | Silverbrook | |
| 7,758,161 | B2 | 7/2010 | Silverbrook et al. | |
| 8,353,577 | B2 | 1/2013 | McAvoy et al. | |
| 8,506,052 | B2 | 8/2013 | McAvoy et al. | |
| 8,556,373 | B2 | 10/2013 | Buestgens et al. | |
| 2012/0268513 | A1 * | 10/2012 | Huffman et al. | 347/11 |

* cited by examiner

*Primary Examiner* — Alejandro Valencia
(74) *Attorney, Agent, or Firm* — Maginot Moore & Beck LLP

(57) ABSTRACT

A printer includes a printhead configured to eject high viscosity material and refill a reservoir in the printhead with high viscosity material. The printhead includes a transducer having an electroactive element and a member to which the electroactive element is mounted. An electrical signal activates the electroactive element to move the electroactive element and the member in the reservoir of high viscosity material. This movement thins the high viscosity material and enables the printhead to eject the thinned material while refilling the reservoir. The apertures through which the thinned material is ejected share a common manifold without separate chambers for each of the apertures.

16 Claims, 5 Drawing Sheets

DOUBLE SUPPORTED BEAM

SINGLE SUPPORT BEAM

PRINTHEAD CONFIGURED FOR USE WITH HIGH VISCOSITY MATERIALS

TECHNICAL FIELD

The device disclosed in this document relates to printheads that eject high viscosity materials and, more particularly, to printers that produce three-dimensional objects with such materials.

BACKGROUND

Digital three-dimensional manufacturing, also known as digital additive manufacturing, is a process of making a three-dimensional solid object of virtually any shape from a digital model. Three-dimensional printing is an additive process in which one or more printheads eject successive layers of material on a substrate in different shapes. The substrate is either supported on a platform that can be moved three dimensionally by operation of actuators operatively connected to the platform. Additionally or alternatively, the printhead or printheads are also operatively connected to one or more actuators for controlled movement of the printhead or printheads to produce the layers that form the object. Three-dimensional printing is distinguishable from traditional object-forming techniques, which mostly rely on the removal of material from a work piece by a subtractive process, such as cutting or drilling.

In some three-dimensional object printers, one or more printheads having an array of nozzles are used to eject material that forms part of an object, usually called build material, and to eject material that forms support structures to enable object formation, usually called support material. Most multi-nozzle printheads contain cavities that are filled with the type of material to be ejected by the printhead. These cavities are pressurized to eject drops of material, but they can only print materials having a very limited range of viscosities. Typically, these materials have a viscosity in the 5-20 cP range. Some materials considered ideal for manufacturing objects have viscosities that greater than those of materials that can be used in currently known printheads.

To overcome the limitations associated with high viscosity materials, single nozzle printheads have been used to eject materials to form objects. These single nozzle printheads are too large to be manufactured as arrays. Consequently, the productivity of the objects that can be produced by these printheads is limited. Printheads capable of enabling higher viscosity fluids to flow through the channels in a printhead and be ejected from the printheads would be advantageous.

SUMMARY

A printhead that enables higher viscosity fluids to flow through the channels in the printhead and be ejected from the nozzles in the printhead includes a reservoir configured with at least one wall to hold a volume of a high viscosity material, at least one transducer having an electroactive element that is mounted to a member, and an electrical conductor electrically connected to the electroactive element of the at least one transducer to enable a controller to activate the at least one electroactive element with a first electrical signal and move the member in the high viscosity material adjacent to the electroactive element and the member to thin the high viscosity material and enable the thinned material to move away from the at least one transducer.

A printer that incorporates the printhead that enables higher viscosity fluids to flow through the channels in the printhead and be ejected from the nozzles in the printhead includes a platen, a printhead positioned to eject material onto the platen to form an object, the printhead comprising: a reservoir configured with at least one wall to hold a volume of a high viscosity material, at least one transducer having an electroactive element that is mounted to a member, and an electrical conductor electrically connected to the electroactive element of the at least one transducer to enable a controller to activate the at least one electroactive element with a first electrical signal and move the member in the high viscosity material adjacent to the electroactive element and the member to thin the high viscosity material and enable the thinned material to move away from the at least one transducer.

BRIEF DESCRIPTION OF THE DRAWINGS

The foregoing aspects and other features of a printhead or printer that enables higher viscosity fluids to flow through the channels in the printhead and be ejected from the nozzles in the printhead are explained in the following description, taken in connection with the accompanying drawings.

DETAILED DESCRIPTION

Figure 1:
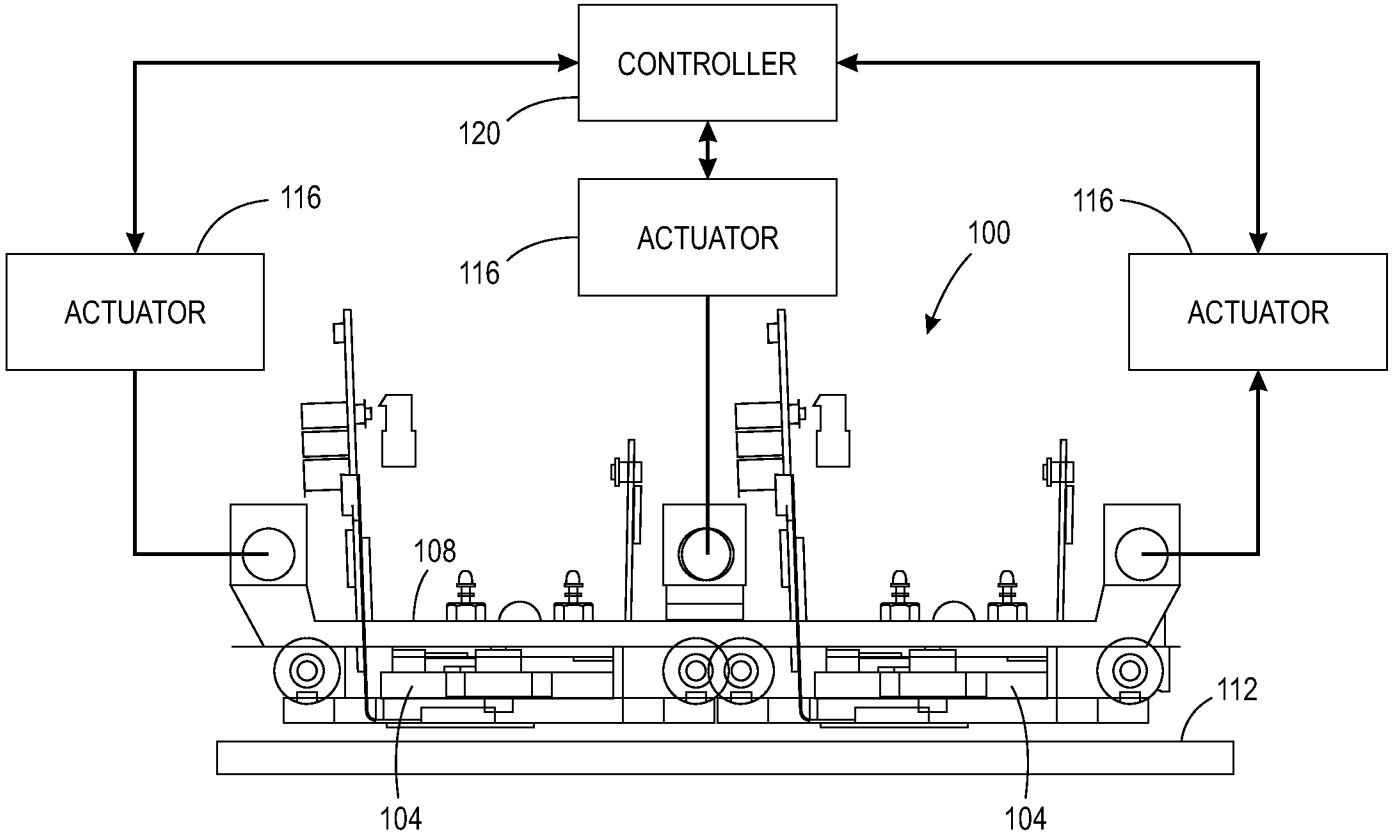
FIG. 1 is block diagram of a printhead and platen configuration in a three-dimensional object printer.

For a general understanding of the environment for the printhead and printer disclosed herein as well as the details for the printhead and printer, reference is made to the drawings. In the drawings, like reference numerals designate like elements.

FIG. 1 shows a configuration of printheads, controller and a platen in a printer 100, which produces a three-dimensional object or part on a platen 112. The printer 100 includes a support platen 112 over which two printheads 104 are carried by a frame 108. While the figure shows two printheads, a single printhead or more than two printheads can be used to configure a printer for forming three-dimensional objects. One of the printheads 104 can be operatively connected to a supply of building material and the other one operatively connected to a supply of support material. The frame 108 to which the two printheads 104 are mounted is operatively connected to actuators 116, which are operatively connected to a controller 120. The controller is configured with electronic components and programmed instructions stored in a memory operatively connected to the controller to operate the actuators and move the frame in an X-Y plane and a Z plane relative to the stationary platen. The X-Y plane is parallel to the surface of the platen 112 opposite the printheads 104 and the Z plane is perpendicular to the surface of the platen. Alternatively, the platen 112 can be operatively connected to the actuators 116 and the controller 120 to enable the controller to move the platen in the X-Y plane and the Z plane relative to the stationary frame 108 and printheads 104. In yet another alternative embodiment, the frame 108 and the platen 112 can be operatively connected to different actuators to enable the controller 120 to move both the platen and the frame in the X-Y plane and the Z plane.

While the platen 14 of FIG. 1 is shown as a planar member, other embodiments of three-dimensional object printers include platens that are circular discs, an inner wall of a rotating cylinder or drum, or a rotating cone. The movement of the platen and the printhead(s) in these printers can be described with polar coordinates. The internal structure of the printheads discussed below that enable higher viscosity materials to be used in the printheads 104 can be used with any of the alternative platens.

Figure 2:
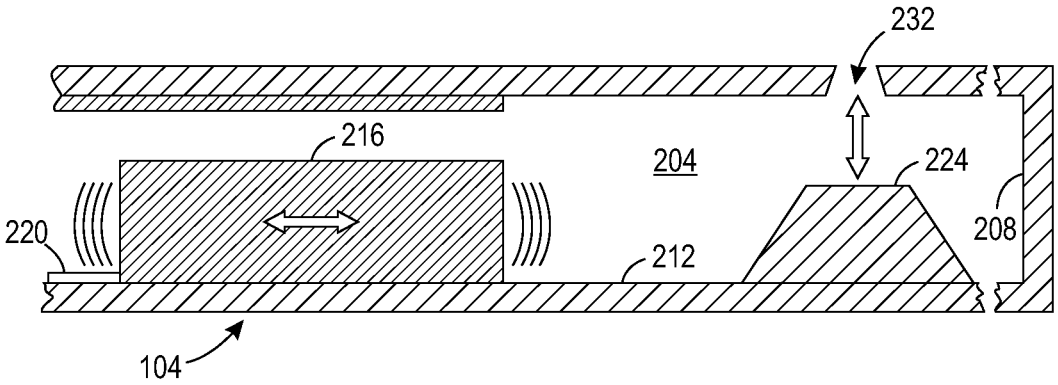
FIG. 2 is a cross-sectional view of one of the printheads shown in of FIG. 1.

In the cross-sectional view of a portion of one of the printheads 104 provided in FIG. 2, a reservoir 204 with a wall 208 holds high viscosity material. As used in this document, "high viscosity material" refers to a material having a viscosity that is greater than 20 cP at the operating temperature of the printhead and that possesses the property called shear thinning. "Shear thinning" means that the viscosity of the material decreases in response to shear stress. A class of materials that exhibits shear thinning is pseudoplastics. The thinning of psuedoplastics is time independent. Additionally, many materials that can be used in object manufacturing processes are thixotropic, which indicates the thinning of the material is time dependent. That is, as the time to which the material is subjected to shear stress is increased, the viscosity of the material continues to decrease.

With continued reference to FIG. 2, a transducer 210 includes an electroactive element 216, a member 212 having a protrusion 224. As used in this document, the term "electroactive element" means any material that responds to an electrical signal by changing its length in at least one dimension. The electroactive element 216 is electrically connected to an electrical conductor 220 to enable an electrical signal to be applied to the element 216, which bends in response to the signal. The electroactive element 216 can be a piezoelectric element, a capacitive element, or the like. The member 212 is bonded to the electroactive element 216 and extends into the reservoir 204. The member 212 can terminate prior to the wall 208 or the member 212 can be attached to wall 208. In some embodiments, the member 212 has a bending modulus that is different than the bending modulus of the transducer 216 so the junction between the transducer and the floor acts as a bimorph. The member 212 moves in response to the bending of the electroactive element 216. The protrusion 224 is part of the member 212 so member 224 moves in response to the movement of the member 212. A controller, such as controller 120, can be electrically connected to the conductor 220 to generate an electrical signal that activates the electroactive 216 so the member 212 and protruding member 224 of the transducer 210 move relative to the high viscosity material in the reservoir 204 to produce shear stress in the material. This shear stress decreases the viscosity of the material to levels that enable the material to flow within the reservoir. As shown in FIG. 2, the electrical signal provided on the electrical conductor 220 causes the electroactive element 216 to expand or contract in a transverse direction indicated by the arrows in the figure and causes the member 212 to bend. The high viscosity material adjacent the electroactive element 216 and the member 212 moves in response to the transducer 210 activation, while the material further away from the transducer does not move. This difference produces shear stress in the material adjacent the transducer. As the material adjacent to the transducer 210 decreases in viscosity in response to the shear stress, it flows away from the moving components of the transducer 210.

Figure 4:
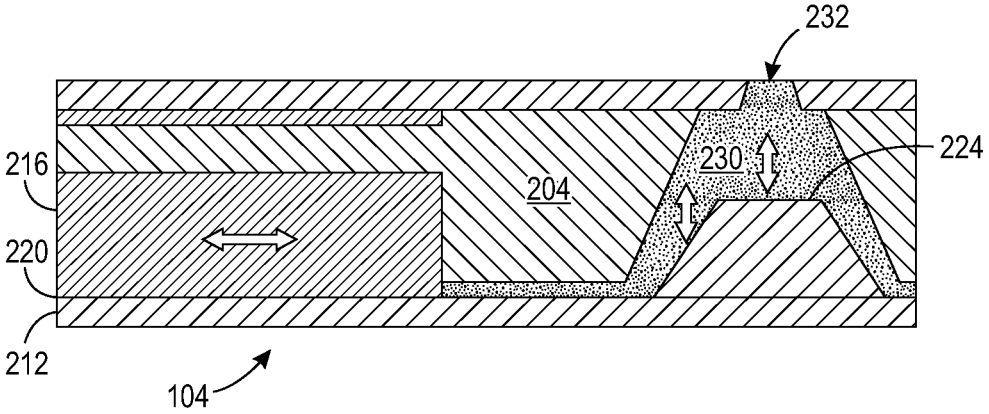
FIG. 4 is an illustration of how a single transducer can be configured to operate a member to eject material and facilitate replenishment of material in the vicinity of the member.

In one embodiment, the electroactive element is a piezoelectric material and the member 212 is a substrate of metal. In response to the activation of the electroactive element 216, the portion of the member 212 between the element 216 and the member 224 acts as a cantilever and moves the protrusion 224 of the member 212 up and down. The up and down movement of the protrusion 224 operates as a hammer in the high viscosity fluid in reservoir 204. This hammer action imparts shear stress to the high viscosity fluid over the protrusion 224 and decreases the viscosity of that fluid. This decrease in viscosity and the energy provided by the protrusion 224 ejects a portion of the thinned high viscosity material through a nozzle 232 in the substrate 228 that joins the wall 208 to enclose the reservoir 204. The thinning of the high viscosity fluid in the vicinity of the electroactive element 216 and member 212 along with the thinning of the high viscosity fluid above the protrusion 224 causes the thinned material at the element 216 and member 212 to migrate toward the protrusion 224 to replace the thinned material ejected from the nozzle 232. In effect, the thinning of the material in these two regions form a channel 230 (FIG. 4) of thinned fluid that not only enables the ejection of material from the printhead, but the replenishment of material in the printhead as well.

Figure 3:
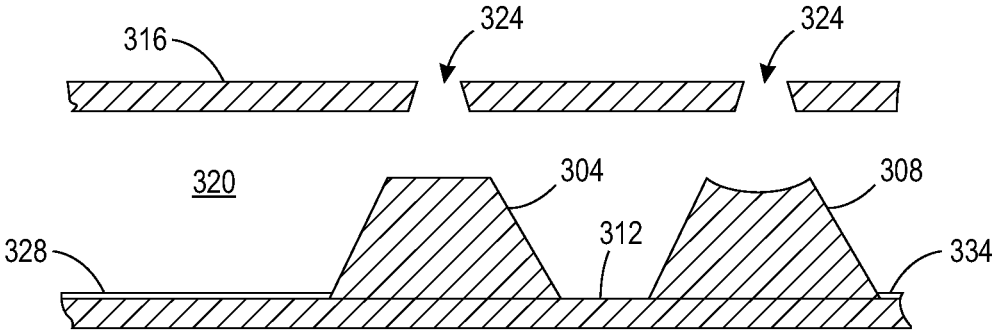
FIG. 3 is a cross-sectional view of an alternative embodiment of a printhead in the configuration of FIG. 1.

FIG. 3 illustrates another advantage that arises from the use of the shear stress produced by transducers to eject high viscosity materials from nozzles in a printhead. In FIG. 3, the electroactive elements 304 and 308 are mounted to member 312. The substrate 316 that encloses the reservoir 320 includes two nozzles 324. In previously known printheads, each electroactive element faces a pressure chamber that holds ink until the activation of the electroactive element urges a portion of the ink in the pressure chamber outwardly through a nozzle communicating with the pressure chamber. Each pressure chamber and transducer is mechanically insulated from adjacent pressure chambers and transducers by walls of a substrate in which the pressure chambers are formed. This mechanical insulation is important in previously known printheads because the movement of an electroactive element in low viscosity fluid could perturb ink in an area opposite an adjacent electroactive element and perhaps even eject ink from the nozzle opposite the adjacent element. Consequently, mechanically insulating structures were required between adjacent electroactive elements to prevent mechanical cross-talk between adjacent inkjet ejectors. Fully mechanically insulating structures are not required in printheads in which high viscosity material is ejected because the high viscosity material increasingly attenuates the shear stress as distance of the shear stress from the moving component decreases. Therefore, printheads ejecting high viscosity materials using the structures shown in FIG. 2 and FIG. 3 do not need the more complex mechanical insulating structures necessary in printheads ejecting low viscosity fluids.

As shown in FIG. 3, the nozzles 324 in substrate 316 communicate pneumatically with each other with no mechanical structure insulating the nozzles from one another. In an example, electrical conductor 328 delivers an electrical signal to electroactive element 304, but no electrical signal is delivered over electrical conductor 334 to electroactive 308. Accordingly, the pressure wave produced by the expansion and contraction of electroactive element 304 is directed towards the nozzle 324 opposite the transducer to thin the high viscosity material between the element 304 and the nozzle 324 and eject a portion of the thinned material through that nozzle 324. The high viscosity material in the portion of the reservoir 320 between the two electroactive elements and the two nozzles dampens any shear stress that emanates beyond the side boundaries of the bimorph formed by electroactive element 304 and the member 312. Consequently, the high viscosity material between the electroactive element 308 and the nozzle 324 opposite that transducer is not thinned and no drop is ejected from that nozzle. Thus, the structure of a printhead configured for use with high viscosity material can be more mechanically simple than ink or other low viscosity fluid ejecting printheads since they do not require chambers enclosing each nozzle and containing a narrow fluidic inlet.

Figure 5:
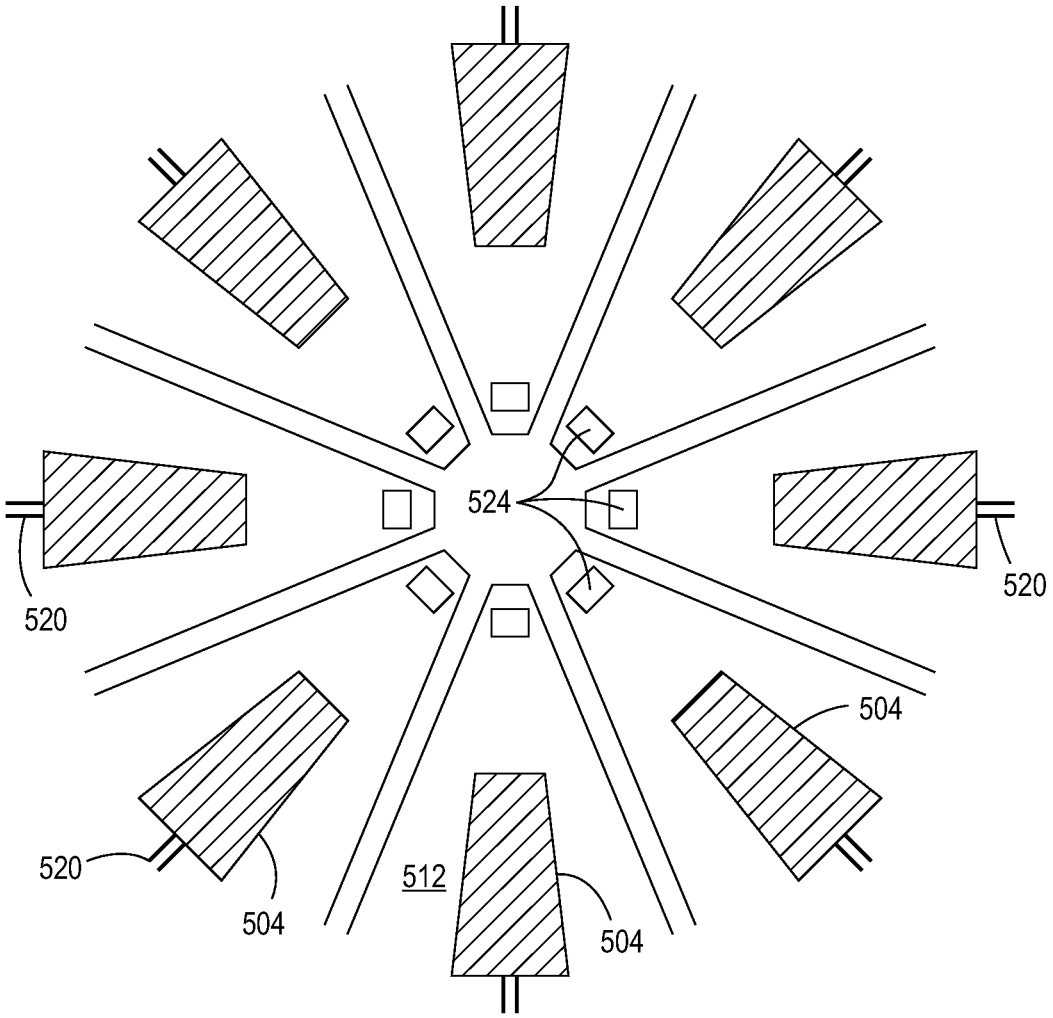
FIG. 5 is an illustration of a plurality of transducers in a radial pattern within a material reservoir.

FIG. 3 also depicts the two electroactive elements 304 and 308 with different top surfaces. Specifically, electroactive element 304 has a planar top surface, while electroactive element 308 has a concave top surface. The concave surface can focus the pressure wave produced by the expansion and contraction of the electroactive element 308 better than the flat surface of the electroactive element 304. Other surface shapes and configurations are also possible. Additionally, the transducers shown in the figures have a tapered shape, although other shapes can be used. For example, the transducers can be circular, cylindrical, square, rectangular or the like. Additionally, a plurality of transducers can be configured in a radial pattern as shown in FIG. 5. In that figure, a plurality of electroactive elements 504 are mounted to member 512 in a radial pattern. Each electroactive element 504 has an electrical conductor 520 to enable each transducer to receive an electrical signal from the controller independently of the other transducers in the radial pattern. Additionally, member 512 includes protrusions 524, which are positioned on the member 512 at a distance from a corresponding electroactive element 504 to operate as a hammer to thin and eject material through an aperture in another layer positioned above the protrusion 524, but not shown in the figure. While the transducers are described above as being piezoelectric transducers, other transducer types can be used such as thermal, electrocapacitive or the like.

Figure 6:
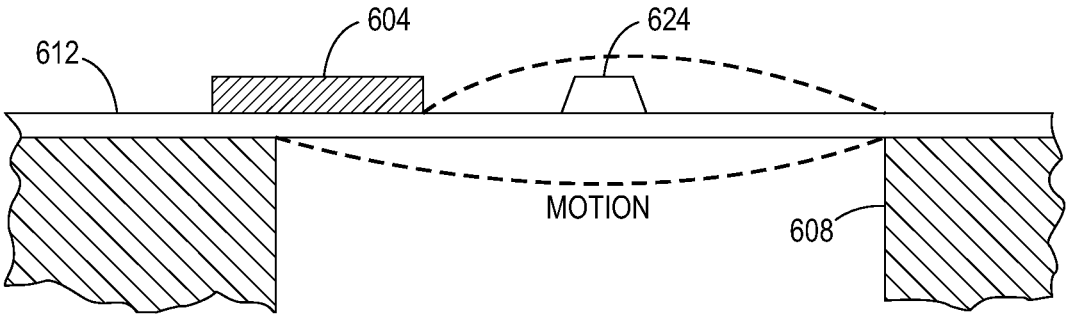
FIG. 6 is an illustration of a double support beam configuration.
Figure 7:
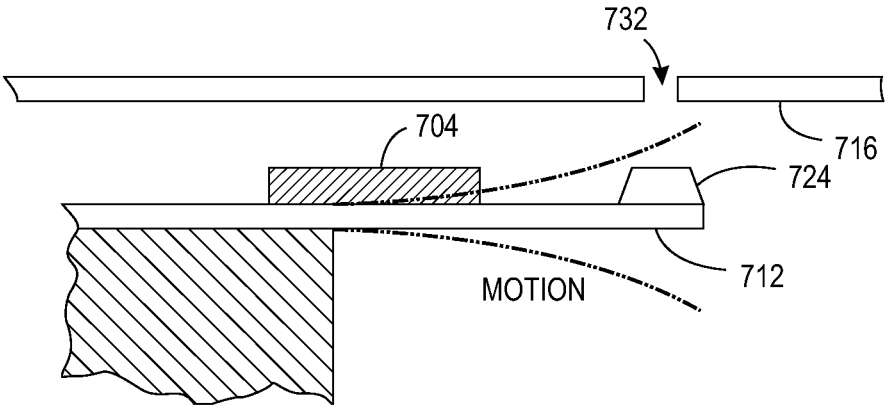
FIG. 7 is an illustration of a single support beam configuration.

As noted above, the member 212 can terminate prior to contacting wall 208 or it can join wall 208. FIG. 6 shows an embodiment of a protruding member 624 mounted to a member 612 that is joined to wall 608. This configuration is called a double supported beam structure. In response to the activation of the electroactive element 604 by an electrical signal, the protruding member 624 modulates in a bowed pattern as indicated in the figure. In FIG. 7, the member 712 does not join a wall so the member 712 has a free end. The protruding member 724 is mounted to the member 712 at or near the free end of the member 712. Consequently, activation of the electroactive element 704 causes the free end of the member 712 and protruding member 724 to swing in a pattern similar to an end of a diving board after a diver has left the board. This action thins the material between the protruding member 724 and the nozzle 732 in substrate 716 to enable a portion of the thinned material to be ejected through the nozzle 732. This configuration is called a single support beam structure.

It will be appreciated that variants of the above-disclosed and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A printhead comprising:

a reservoir configured with at least one wall to hold a volume of a high viscosity material;

a member;

at least one transducer having a plurality of electroactive elements that is mounted to the member;

a plurality of protrusions extending from a surface of the member into the reservoir, the protrusions in the plurality of protrusions being arranged in one-to-one correspondence with the plurality of electroactive elements, each protrusion being part of the member and positioned at a distance from its corresponding electroactive element to enable activation of the corresponding electroactive element to move the member and the protrusion within the reservoir; and a plurality of electrical conductors, each electroactive element being electrically connected to a different electrical conductor in the plurality of electrical conductors to enable a controller to activate each electroactive element independently of the other electroactive elements in the plurality of electroactive elements with electrical signals and move the member and the protrusion extending above the member into the high viscosity material adjacent to the electroactive element and the member to thin the high viscosity material and enable the thinned material to move away from the at least one transducer.

2. The printhead of claim 1 further comprising:

a nozzle in a substrate that encloses a portion of the reservoir;

each protrusion in the plurality of protrusions being positioned to enable a surface of each protrusion to be near the nozzle in the substrate so the movement of the member by at least one electroactive element moves the at least one corresponding protrusion within the reservoir to thin a portion of the high viscosity material between the protrusion and the nozzle and eject a portion of the high viscosity material thinned by the protrusion through the nozzle and to enable the thinned material moving away from the at least one protrusion to replace the ejected thinned material.

3. The printhead of claim 2 further comprising:

another nozzle in the substrate enclosing the reservoir;

at least one other electroactive element mounted to the member of the at least one transducer, the at least one other electroactive element being mounted at a position that enables a surface of the at least one other electroactive element to be near the other nozzle in the substrate; and another electrical conductor electrically connected to the at least one other electroactive element to enable the controller to activate the at least one other electroactive element with other electrical signals and move the member in the high viscosity material to thin the high viscosity material between the at least one other electroactive element and the other nozzle so a portion of the thinned material between the at least one other electroactive element and the other nozzle is ejected from the other nozzle.

4. The printhead of claim 1 wherein the member is essentially comprised of metal.

5. The printhead of claim 1 wherein the electroactive element consists essentially of piezoelectric material.

6. The printhead of claim 2 wherein each protrusion has a tapered volume.

7. The printhead of claim 1 wherein at least one of the electroactive elements is configured to operate in a transverse mode in response to one of the electrical signals on the corresponding electrical conductor.

8. The printhead of claim 2, the member having one end joined to the wall forming the reservoir.

9. A printer comprising:

a platen;

a printhead positioned to eject material onto the platen to form an object, the printhead comprising:

a reservoir configured with at least one wall to hold a volume of a high viscosity material;

a member;

at least one transducer having a plurality of electroactive elements that is mounted to the member;

a plurality of protrusions extending from a surface of the member into the reservoir, the protrusions in the plurality of protrusions being arranged in one-to-one correspondence with the plurality of electroactive elements, each protrusion being mounted to the member at a distance from its corresponding electroactive element to enable activation of the corresponding electroactive element to bend the member and the protrusion within the reservoir; and a plurality of electrical conductors, each electroactive element being electrically connected to a different electrical conductor in the plurality of electrical conductors to enable a controller to activate each electroactive element independently of the other electroactive elements in the plurality of electroactive elements with electrical signals and move the member and the protrusion in the high viscosity material adjacent to the electroactive element to thin the high viscosity material and enable the thinned material to move away from the at least one transducer.

10. The printhead of claim 9, the printhead further comprising:

a nozzle in a substrate that encloses a portion of the reservoir;

each protrusion in the plurality of protrusions being positioned to enable a surface of each protrusion to be near the nozzle in the substrate so the movement of the member by at least one electroactive element moves the at least one corresponding protrusion within the reservoir to thin a portion of the high viscosity material between the protrusion and the nozzle and eject a portion of the high viscosity material thinned by the protrusion through the nozzle and to enable the thinned material moving away from the at least one protrusion to replace the ejected thinned material.

11. The printer of claim 10, the printhead further comprising:

another nozzle in the substrate enclosing the reservoir;

at least one other electroactive element mounted to the member of the at least one transducer, the at least one other electroactive element being mounted at a position that enables a surface of the at least one other electroactive element to be near the other nozzle in the substrate; and another electrical conductor electrically connected to the at least one other electroactive element to enable the controller to activate the at least one other electroactive element with other electrical signals and move the member in the high viscosity material to thin the high viscosity material between the at least one other electroactive element and the other nozzle so a portion of the thinned material between the at least one other electroactive element and the other nozzle is ejected from the other nozzle.

12. The printer of claim 9 wherein the member of the at least one transducer in the printhead is essentially comprised of metal.

13. The printer of claim 9 wherein the electroactive element of the at least one transducer consists essentially of piezoelectric material.

14. The printer of claim 10 wherein each protrusion in the plurality of protrusions is configured as a tapered volume.

15. The printer of claim 9 wherein at least one electroactive element is configured to operate in a transverse mode in response to one of the electrical signals on the corresponding electrical conductor.

16. The printer of claim 10, the member having one end joined to the wall forming the reservoir.

* * * * *